US007311806B2

(12) United States Patent
Ouchi et al.

(10) Patent No.: US 7,311,806 B2
(45) Date of Patent: Dec. 25, 2007

(54) PAPERMAKING NEEDLE FELT

(75) Inventors: Takashi Ouchi, Tokyo (JP); Kazumasa Watanabe, Tokyo (JP)

(73) Assignee: Ichikawa Co. Ltd., Tokyo (JP)

( * ) Notice: Subject to any disclaimer, the term of this patent is extended or adjusted under 35 U.S.C. 154(b) by 619 days.

(21) Appl. No.: 10/800,936

(22) Filed: Mar. 15, 2004

(65) Prior Publication Data

US 2004/0200594 A1 Oct. 14, 2004

(51) Int. Cl.
*D21F 7/08* (2006.01)

(52) U.S. Cl. ..... 162/358.2; 162/199; 162/900; 442/118

(58) Field of Classification Search ..... 162/348, 162/116, 117, 199, 358.2, 900, 902, 903, 162/306; 34/95; 139/383 A, 425 A; 8/110, 8/142; 427/407.1, 394, 412, 384, 385.5, 427/389.9, 393.4; 442/63, 79, 80, 91, 93, 442/118, 164, 168–171
See application file for complete search history.

(56) References Cited

U.S. PATENT DOCUMENTS

| | | | | |
|---|---|---|---|---|
| 3,573,089 | A * | 3/1971 | Tate | 442/19 |
| 4,464,431 | A * | 8/1984 | Hisaki et al. | 442/101 |
| 4,594,286 | A | 6/1986 | McKinney et al. | |
| 4,931,010 | A * | 6/1990 | Barnewall | 442/323 |
| 5,207,873 | A | 5/1993 | Sanduja et al. | |
| 5,298,124 | A * | 3/1994 | Eklund et al. | 162/306 |
| 5,829,488 | A * | 11/1998 | Fagerholm et al. | 139/383 A |
| 6,284,380 | B1 | 9/2001 | Martin et al. | |
| 6,605,188 | B2 * | 8/2003 | Hagfors et al. | 162/306 |
| 6,712,940 | B2 * | 3/2004 | Crook | 162/306 |
| 2004/0040612 | A1 * | 3/2004 | Murakami | 139/383 R |

FOREIGN PATENT DOCUMENTS

| | | | |
|---|---|---|---|
| EP | 0 367 738 | A2 | 5/1990 |
| EP | 0 761 872 | A1 | 3/1997 |
| JP | 55-33811 | B | 9/1980 |
| JP | 10-245788 | A | 9/1988 |
| JP | 02-074675 | B2 | 3/1990 |
| JP | 05-125685 | A | 5/1993 |
| JP | 06-065886 | A | 3/1994 |
| JP | 09078458 | A | 3/1997 |
| JP | 09-105094 | A | 4/1997 |
| JP | 2002-173886 | A | 6/2002 |

* cited by examiner

*Primary Examiner*—Eric Hug
(74) *Attorney, Agent, or Firm*—Wolf, Greenfield & Sacks, P.C.

(57) ABSTRACT

Papermaking felt containing a hydrophilic urethane resin that can maintain functions such as water drainage, wet-paper smoothness, and wet-paper transportability by imparting a hydrophilic property to the papermaking felt thereby preventing the deposition and accumulation of adhesive contaminants without impairing the compression recoverability of the felt thus sustaining its antifouling capability.

8 Claims, 1 Drawing Sheet

PAPERMAKING NEEDLE FELT

DETAILED DESCRIPTION OF THE INVENTION

1. Field of the Invention

The present invention relates to a felt for use in the press part of papermaking machinery, and particularly to a papermaking felt having an improved antifouling capability.

2. Prior Art

In a papermaking machine for removing water from the raw material of paper, dewatering is performed successively in three main parts: forming, press, and drying, each of which utilizes a different papermaking tool is corresponding to its dewatering function. The press part utilizes a papermaking felt, which is constructed by laminating a base body (primarily of woven fabric) with a short-fiber (primarily of 2 to 50 dtex) batt and implanting fibers by needle punching and the like.

The papermaking felt has basic functions such as squeezing water from the wet paper (water drainage), improving the smoothness of the wet paper (smoothness), and transporting the wet paper (wet paper web transport capability); out of these papermaking felt functions, the function of squeezing water out of the wet paper is particularly valued. Such a function requires sustained water permeability and compression recoverability of the felt since water in the wet paper is transferred to the felt by applying pressure thereon while passing through between a pair of press rolls and then the water in the felt is discharged out of the felt by applying pressure thereon or by sucking it with a suction box of the papermaking machine.

Recently, much progress has been made in the recycling of used paper products from the viewpoint of environmental conservation and thereby the ratio of the recycled raw material to the raw paper material has increased. Such recycled raw materials contain some contaminants and fillers, which accumulate in the papermaking tools thereby causing various problems. A papermaking felt, which has an intricate inner structure, is particularly subject to accumulation of contaminants and fillers; these materials tend to accumulate in the felt during its use period and reduce its water permeability and compression recoverability significantly degrading the water drainage and wet-paper smoothness of the felt.

Practical countermeasures to cope with such contamination of the felt have been to wash the felt by applying a high-pressure shower while the papermaking machine is in operation, or to wash it with a washing agent while the papermaking machine is halted. However, such countermeasures cause physical damages to the short fibers of the felt as well as chemical degradation of the fibers due to the effect of washing agent result in a problem that the short fibers fall off adhering to the paper and the flattening of the short fibers is accelerated thereby degrading the felt functions and therefore impairing the productivity of the papermaking machine.

One method to solve this problem has been proposed in which a protective coating is applied on the papermaking tools used in the papermaking machine for preventing the deposition of contaminants. For example, one such method is to apply a coating containing a fluorinated compound as the antifouling component (for example, see patent documents 1, 2). However, applying a coating containing a fluorinated compound will make the felt be hydrophobic, which will prevent the water transfer from the wet paper to the felt and thereby reduce the adhesiveness between the wet paper and the felt resulting in a problem that the wet paper is peeled off while being transported.

Also proposed is a method to prevent the deposition of adhesive contaminants in which the antifouling component included in a coating contains a hydrophilic antifouling component such as a polyvinyl pyrrolidone compound and hydrophilic polyester (see, for example, patent document 3, 4, and 5). However, in the case of the papermaking felt for use in the press part of papermaking machinery, if only a hydrophilic antifouling component such as polyvinyl pyrrolidone and hydrophilic polyester is coated, the hydrophilic antifouling component will liquate out of the felt when water passes therethrough. Also, since the felt is repeatedly pressurized by a pair of press rolls, the short fibers in the felt rub against each other thereby causing the hydrophilic antifouling component to be removed; thus, it is difficult to sustain the effects of the felt.

Moreover, if a hydrophilic antifouling component which is mixed with a thermosetting resin is applied to the felt and dried to form a hydrophilic resin film for improving its sustainability, the short fibers in the felt will become hard due to the thermosetting resin film or the felt will be hardened due to the adhesion of short fibers caused by the thermosetting resin, thus resulting in a problem that the compression recoverability of the felt is degraded due to its hardening. In this case, another problem arises in that the degradation of the compression recoverability causes the water flow in the felt, which depends on the recovery from compression, to decrease thereby decreasing the effect of discharging the contaminants out of the felt with water flow and therefore accelerating the accumulation of the contaminants.

In addition, since thermosetting resins are generally hydrophobic and therefore degrade the hydrophilicity of the felt, it was necessary to use an increased amount of hydrophilic antifouling component.

On the other hand, a urethane resin may be used for the purpose of improving the functions of the papermaking tools. For example, its use in the dryer canvas in the drying part will improve its dimensional stability, transport stability and wear resistance (see patent document 6) or its use in a polishing needle felt will enhance the holding ability of abrasive grains and the adhesion to the surface to be ground thereby making it possible to improve the grinding efficiency and the quality of the ground surface (see patent document 7). However, these are not intended to impart a compression recoverability, hydrophilic nature and water permeability to the felt, and no attempt has been made to enhance the functionality of the papermaking tools in the press part by using a urethane resin.

As described above, there is a need for developing means for maintaining the antifouling capability of the felt throughout its entire period of service while maintaining basic functions of the papermaking felt, particularly the functions required in the press part such as water drainage, wet-paper smoothness, and wet paper web transport capability.

[Patent document 1] JP, A, 10-245788
[Patent document 2] JP, A, 06-65886
[Patent document 3] Japanese Patent No.2976152
[Patent document 4] JP, A, 09-105094
[Patent document 5] JP, A, 2002-173886
[Patent document 6] JP, B, 55-33811
[Patent document 7] Japanese Patent No.2673558

Problems to be Solved by the Invention

Accordingly, the object of the present invention is to impart a hydrophilic property to the polyamide fiber which constitutes the papermaking felt thereby preventing the deposition and accumulation of adhesive contaminants (particularly hydrophobic ones), and to sustain such antifouling capability for a long period of time with out impairing the compression recoverability of the papermaking felt and thereby maintaining the functions such as water drainage, wet-paper smoothness, and wet paper web transport capability throughout its entire service period.

Means for Solving the Problem

The present inventors have conducted extensive research to solve the above described problems and have found that hydrophilic urethane resins are useful, and further continued the research to eventually complete the invention.

Thus, the present invention relates to a papermaking felt comprising a hydrophilic urethane resin.

The present invention also relates to the above described papermaking felt, characterized in that the hydrophilic urethane resin is provided through polymerization of a blocked hydrophilic urethane prepolymer.

The present invention further relates to the above described papermaking felt, characterized in that the blocked hydrophilic urethane prepolymer contains ethylene oxide.

The present invention further relates to the above described papermaking felt, characterized in that the ethylene oxide constitutes 35% to 95% by molecular weight of the blocked hydrophilic urethane prepolymer.

The present invention further relates to the above described papermaking felt, characterized in that the hydrophilic urethane resin constitutes 0.5% to 10% by weight of the papermaking felt.

The present invention further relates to the above described papermaking felt, characterized by further comprising an anchoring agent.

The present invention further relates to the above described papermaking felt, characterized in that the anchoring agent is N-methylol acrylamide.

The present invention further relates to the above described papermaking felt, characterized in that the hydrophilic urethane resin constitutes 0.5% to 10% by weight and the N-methylol acrylamide constitutes 0.1 to 5% by weight of the papermaking felt.

The present invention further relates to the above described papermaking felt, characterized by further comprising a hydrophilic polyester resin.

The present invention further relates to the above described papermaking felt, characterized in that the hydrophilic urethane resin constitutes 0.5% to 10% by weight, the N-methylol acrylamide constitutes 0.1% to 5% by weight, and the hydrophilic polyester resin constitutes 0.5% to 5% by weight of the papermaking felt.

In the papermaking felt of the present invention, when blocked hydrophilic urethane prepolymer (A) is applied on the papermaking felt as the antifouling agent and thereafter is heat-treated, the blocking agent of (A) is dissociated causing free isocyanate groups to be regenerated and bond to a molecular terminal group of polyamide, and also the regenerated isocyanate group undergoes self-crosslinking reaction between its molecules to form a polyurethane film layer having a three-dimensional mesh structure on the surface of polyamide fiber. The polyethylene oxide chain of (A) imparts hydrophilic function to the felt fiber surface thus preventing the deposition of contaminants and, due to the effect of the isocyanate group spreading in a mesh-form on the surface of polyamide fiber, it is made possible to maintain a high compression recoverability state for a long period of time.

Therefore, adhesive contaminants are less prone to be deposited on the felt fiber surface and also contaminants are less prone to be accumulated within the felt due to a so called self-purification effect, in which contaminants having entered into the felt is discharged out of the felt by water flow within the felt which occurs during compression recovery, and thus it is made possible to prevent the deposition and accumulation of contaminants.

In the case of a papermaking felt containing a mixture consisting of blocked hydrophilic urethane prepolymer (A) and N-methylol acrylamide (B) as the antifouling agent, before (A) is thermally dissociated, the methylol group of (B) causes the polyamide fiber, which constitutes the papermaking felt, to undergo a chemical bonding, specifically graft polymerization. This graft bond chain functions as a base, or a so-called anchoring agent, to cause (A) to be anchored.

Therefore, if heat treatment is performed after applying a mixture consisting of (A) and (B) as antifouling agent on the papermaking felt, the methylol group of (B), taking precedence over (A), adds a graft bond chain to the polyamide fiber which constitutes the papermaking felt. Next, the blocking agent of (A) is dissociated to cause free isocyanate groups to be regenerated and immediately react with a vinyl group, which is a functional residual group of (B), thereby getting polymerized. That is, (B) enhances the sustainability of the antifouling capability provided by the component (A). by indirectly strengthening the chemical bonding strength of (A) with the polyamide fiber.

According to the present invention, in the case of a papermaking felt containing a mixture consisting of blocked hydrophilic urethane prepolymer (A) and hydrophilic polyester resin (C) as the antifouling agent, by applying the mixture consisting of (A) and (C) on the papermaking felt and thereafter heat treating it, the blocking agent is dissociated causing free isocyanate groups to be regenerated and bond to a molecular terminal group of polyamide fiber, and the regenerated isocyanate group undergoes a self-crosslinking reaction between its molecules to form a polyurethane film layer having a three-dimensional mesh structure on the surface of polyamide fiber. Next, since the isocyanate group in (A) spreads in a mesh-form, (c) is taken into this structure and is anchored thereby increasing the hydrophilic function of the surface of the felt fiber and enhancing the deposition prevention of contaminants.

In the case of a felt containing a mixture consisting of blocked hydrophilic urethane prepolymer (A), hydrophilic polyester resin (C) and N-methylol acrylamide (B) as the antifouling agent, the methylol group of (B) causes the polyamide fiber which constitutes the papermaking felt to undergo chemical bonding, specifically graft polymerization. This graft bond chain functions as a base, or as a so-called anchoring agent, to cause (A) and (C) to be anchored.

Therefore, by applying a mixture consisting of (A), (C) and (B) as antifouling agent on the papermaking felt and thereafter heat treating it, the methylol group of (B) preferentially adds graft bond chain to the polyamide fiber which constitutes the papermaking felt. Next, the blocking agent of (A) is dissociated to cause free isocyanate groups to be regenerated and immediately react with a vinyl group, which is a functional residual group of (B), thereby getting polymerized.

Further, since the isocyanate group in (A) spreads in a mesh-form, while (c) is taken into this structure to be anchored thereby enhancing the hydrophilic function of the surface of the felt fiber, this structure enhances the sustainability of the antifouling capabilities of (A) and (C) due to the function of the anchoring agent.

Next, the embodiments of the present invention will be described.

EMBODIMENTS OF THE INVENTION

The hydrophilic urethane resin used in the present invention is typically a compound prepared through addition polymerization of aliphatic or alicyclic polyisocyanate with a compound $R_1$ having a hydrophilic group as given by formula I.

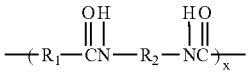

(I)

where, $R_1$ is a polyol component having a hydrophilic group such as ethylene oxide, $R_2$ is an aliphatic group such as $(CH_2)_n$, for example, $C_6H_{12}$, or an alicyclic group such as:

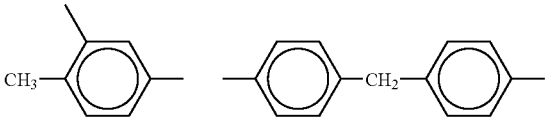

where X is a whole number of 3 to 300.

One embodiment of the hydrophilic urethane resin is synthesized from blocked hydrophilic urethane prepolymer (A) which is obtained by treating urethane polymer containing ethylene oxide and having an active isocyanate group with bisulfite and/or blocked organic substance, where (A) has 35% to 95% of ethylene oxide based on its molecular weight and, thus, 0.5% to 10% by weight of (A) as the water-evaporated residue, i.e., hydrophilic urethane resin is contained in the papermaking felt.

In another embodiment, the papermaking felt comprises (A) and N-methylol acrylamide (B) which is an anchoring agent; 0.5% to 10% by weight of (A) as the water-evaporated residue, i.e., hydrophilic urethane resin and 0.1% to 5% by weight of (B) are contained based on the weight of the papermaking felt.

In a further embodiment, the papermaking felt comprises (A) and hydrophilic polyester resin (C); 0.5% to 10% by weight of (A) as water-evaporated residue, i.e., hydrophilic urethane resin and 0.5% to 5% by weight of (C) are contained based on the weight of the papermaking felt.

In a still further embodiment, the papermaking felt comprises (A), (B) and (C); 0.5% to 10% by weight of (A) as the water-evaporated residue, i.e., hydrophilic urethane resin, 0.1% to 5% by weight of (B), and 0.5% to 5% by weight of (C) are contained based on the weight of the papermaking felt.

Another embodiment of the above described hydrophilic urethane resin is synthesized from blocked hydrophilic urethane polymer (A) containing ethylene oxide and having an active isocyanate group. The number of active isocyanate groups per one molecule of hydrophilic urethane prepolymer, i.e., the average number of functional groups of hydrophilic urethane prepolymer is preferably 1 to 3.

The blocked hydrophilic urethane prepolymer (A) preferably has 35% to 95% of ethylene oxide based on its molecular weight.

The embodiments of blocked hydrophilic urethane prepolymer will be described in more detail below.

The blocked hydrophilic urethane prepolymer (A) used in the present invention is configured such that an urethane prepolymer containing ethylene oxide and having 1 to 3 active isocyanate groups per one molecule is blocked with bisulfite and/or an organic blocking agent, and the blocking agent is dissociated by heat treatment to cause the active isocyanate groups to be regenerated to form an urethane resin film through a crosslinking reaction.

In this synthesis method, any proportion of a compound having one or more active hydrogen groups and organic polyisocyanate are made to react to form a hydrophilic urethane prepolymer containing ethylene oxide and active isocyanate groups, and thereafter a blocking agent, which is to be dissociated by heat, is added.

The compound having an active hydrogen group to be used in the foregoing process is usable in the range that the content of ethylene oxide per molecule is 0% to 100% by weight. The plurality of compounds having active hydrogen groups and containing different amounts of ethylene oxide may be concurrently used as the prepolymer component.

Moreover, this compound containing active hydrogen groups may include a plurality of those having different number of active hydrogen groups concurrently.

The above described compound having active hydrogen groups may include followings.

The compound having one active hydrogen group includes compounds obtained through addition polymerization of alkyl alcohol with alkylene oxide.

The compound having not less than two active hydrogen groups includes polyether polyol, polyester polyol, and polyester polyether polyol.

The above described organic polyisocyanate compound includes tolylene diisocyanate (TDI), diphenylmethane diisocyanate (p-MDI), liquid MDI exemplified by polyphenyl polymethyl polyisocyanate, coarse MDI, hexamethylene diisocyanate (HMDI), xylylene diisocyanate (XDI), tetramethylxylylene diisocyanate (TMXDI), hydrogenated diphenylmethane diisocyanate ($^{12}$H-MDI), and isophorone diisocyanate (IPDI).

With these constitutional units, a compound having one or more active hydrogen groups is made to react with a polyol component and organic polyisocyanate to obtain a hydrophilic urethane prepolymer having ethylene oxide and active isocyanate groups.

In preparing the compound having active hydrogen groups used in the foregoing process, the molar ratio of the polyol component to the organic polyisocyanate (molar ratio of active hydrogen group/NCO group) is also arbitrary selected so that the number of the active isocyanate groups of hydrophilic urethane prepolymer is 1 to 3 per one molecule as described above.

The hydrophilic urethane prepolymer containing active isocyanate groups is made to react with a blocking agent to be blocked.

Thus synthesized blocked hydrophilic urethane prepolymer is a stable, water soluble, heat-reactive hydrophilic urethane composition, and when heat treated at 100 to 180° C. the blocking agent is dissociated causing isocyanate groups to be regenerated, and then the isocyanate groups react to be polymerized.

Moreover, the blocked hydrophilic urethane prepolymer (A) preferably contains not less than 35% by molecular weight of ethylene oxide in terms of hydrophilicity and compression recoverability and not more than 95% in terms of durability.

A preferable content of the blocked hydrophilic urethane prepolymer (A) is, in terms of compression recoverability and impairment of water squeezing function, 0.5% to 10% by weight of (A) as the water-evaporated residue, i.e., hydrophilic urethane resin based on the weight of the papermaking felt.

The N-methylol acrylamide (B) is a bifunctional monomer, which is a highly reactive organic compound (see formula (1)) having a methylol group (—$CH_2OH$) and a polymerizable vinyl group ($CH_2$=CH—).

$$CH_2{=}CH{-}CONH{-}CH_2OH \quad (1)$$

The content of N-methylol acrylamide (B) is preferably 0.1% to 5% by weight based on the weight of the papermaking felt in terms of compression recoverability.

The hydrophilic polyester resin (C) is a hydrophilic polyester resin containing a polyethyleneoxy group (formula (2)).

(2)

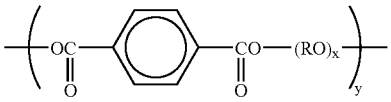

(where x is a whole number from 8 to 200, y is a whole number from 3 to 30, and R represents an alkylene group having 2 to 6 carbon atoms.)

A preferable example of the hydrophilic polyester resin (C) of the present invention is a hydrophilic polyester resin obtained through polycondensation of sulphonated terephthalic acid and polyethyleneoxide added terephthalic acid (formula (3)).

(3)

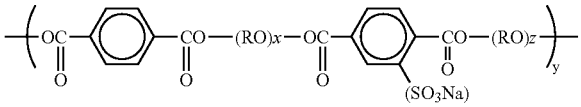

(where x and z are whole numbers from 8 to 200, y is a whole number from 3 to 30, and R represents an alkylene group having 2 to 6 carbon atoms.)

As one use of this hydrophilic polyester resin (C), it can be directly applied on polyamide fiber thereby exhibiting soil release property (antifouling processing agent); however, it is impossible to maintain the unique configuration and function of the present invention for an extended period of time.

A preferable content of the hydrophilic polyester resin (C) is 0.5% to 5% by weight based on the weight of the papermaking felt. In terms of antifouling effect on the felt, not less than 0.5% by weight is preferable, and in terms of water drainage, not more than 5% by weight is preferable.

Thus obtained blocked hydrophilic urethane prepolymer (A) alone, or a mixture consisting in combination of not less than two components selected from blocked urethane prepolymer (A) which being the essential component, N-methylol acrylamide (B) and hydrophilic polyester resin (C) is added to the papermaking felt and heat treated at 100 to 180° C. to be brought into a chemical reaction with the polyamide fiber which constitutes the papermaking felt, thereby obtaining a papermaking felt imparted with antifouling capability.

These antifouling components are added to the papermaking felt by dipping, spraying, coating, and so on.

The examples of the present invention will be described below, which are, needless to say, for illustrative purposes and are not intended to limit the present invention.

EXAMPLES

In order to confirm the effect of the papermaking felt according to the present invention, following experiments were conducted.

To make various conditions common to all examples as well as comparative examples, all the felts had following basic configuration.

Base body (plain weave of twisted yarn of nylon monofilament): basis weight 650 g/$m^2$ Batt layer (short fiber of nylon 6): basis weight 750 g/$m^2$ Total basis weight: 1400 g/$m^2$, Needling density: 700 repeats/$cm^2$

Examples 1 to 7

What was used as the blocked hydrophilic urethane prepolymer (A) was an aqueous solution of blocked isocyanate with 30% resin component (56% of ethylene oxide (EO) based on the total molecular weight), which was obtained by adding sodium bisulfite solution to an urethane prepolymer having 3.1% of active isocyanate group, which was composed of ethylene oxide adduct and ethylene oxide/propylene oxide [50:50] adduct and is added with hexamethylene diisocyanate.

A commercial product was used for the N-methylol acrylamide (B).

What was used as the hydrophilic polyester resin (C) was one obtained through polycondensation of sulphonated terephthalic acid with polyethyleneoxide added terephthalic acid.

Thus obtained blocked hydrophilic urethane prepolymer (A) alone, or a mixture consisting in combination of not less than two components selected from blocked hydrophilic urethane prepolymer (A) which being as the essential component, N-methylol acrylamide (B) and hydrophilic polyester resin (C) was sprayed so that weight proportions as the water-evaporated residues were as shown in Table 1 based on the weight of the felt, and was heat treated at 160° C. after drying to be brought into a chemical reaction with the polyamide fiber which constitutes the papermaking felt, thereby obtaining papermaking felts imparted with antifouling capability.

Example 8

As the blocked hydrophilic urethane prepolymer (A), an aqueous solution of blocked isocyanate with 30% of resin component (30% of ethyleneoxide (EO) based on the total molecular weight), which was obtained by adding sodium bisulfite solution to urethane prepolymer having 2.7% of active isocyanate group, which was composed of ethylene oxide adduct, ethylene oxide/propylene oxide [80:20] adduct and propylene oxide adduct and added with hexamethylene diisocyanate was sprayed to the base configuration felt such that the weight proportions as the water-evaporation residues were as shown in table 1, and was heat treated at 160° C. after drying to obtain a desired papermaking felt.

Example 9

As the blocked hydrophilic urethane prepolymer (A), an aqueous solution of blocked isocyanate (93% of ethylene oxide (EO) based on the total molecular weight) with 30% of resin component, which was obtained by adding sodium bisulfite solution to urethane prepolymer having 1.5% of active isocyanate group, which was composed of ethylene oxide adduct with one terminal methyl-sealed and was added with hexamethylene diisocyanate was sprayed to the base configuration felt so that the weight proportions as the water-evaporated residues were as shown in Table 1, and was heat treated 160° C. after drying to obtain a desired papermaking felt.

Comparable Example 1

The base configuration felt was heat-treated at 160° C. to obtain a desired papermaking felt.

Comparable Example 2

The base configuration felt was sprayed with hydrophilic polyester resin (C) similar to that for the foregoing examples so that weight proportions based on the weight of the papermaking felt were as shown in Table 1, and was heat treated after drying at 160° C. to obtain a papermaking felt.

After having prepared the above described papermaking felts, experiments were conducted using an apparatus shown in FIG. 1. The experimental apparatus in FIG. 1 is an apparatus for repeatedly pressing the felt F by rotating it while applying a constant tension thereon with a pair of rolls P. The antifouling capability of the felt was evaluated by spraying water at a water shower W and an artificially contaminated liquid at a shower S.

The artificially contaminated liquid was prepared by drying and thereafter extracting pulp pitch solids deposited at the suction box lip installed at the press part of newspaper making process with a solvent consisting of one part of an one-to-one mixed solvent of ethyl alcohol/benzene and 100 parts of the pitch solids, and homogenizing the extracted liquid (supernatant liquid) with a homogenizer while diluting it with 100 parts of water to obtain a suspension. The amount of fouling caused by this artificially contaminated liquid is expressed as amount of fouling 1.

As the filler based contaminant, a suspension that was prepared by resolving aluminum sulfate into a suspension of 2% talk and adjusting it at pH 5 was sprayed from the shower S, and the antifouling capability of the felt was evaluated. The amount of fouling due to this artificially contaminated liquid is expressed as amount of fouling 2.

The compression recoverability and sustainability of the felts of examples 1 to 9 and of comparative examples 1 to 2 were compared with the experimental apparatus shown in FIG. 1.

The driving conditions of the experimental apparatus were a press pressure of 100 kg/cm$^2$ and a felt drive velocity of 1000 m/min; the test was conducted continuously for 120 hours.

Upon measurement, the values right after starting the experiment and the values at the end of the experiment were determined. Also, compressibility and recoverability factor are determined by measuring the thickness of the felt when subjected to a fixed pressure (30 kg/cm$^2$) after immersing it in water for 1 hour and by using the following equations:

Compressibility (%)=100×(thickness before pressurization−thickness under pressure)/thickness before pressurization Recoverability factor (%)=100×(thickness before depressurization−thickness under pressure)/thickness under pressure A felt which had been immersed in water for one hour was applied with an initial load and the time needed for 30 litter of water to permeate from the front surface to the rear surface was measured, and the water permeability was comparatively evaluated with reference to that of the initial state of comparative example 1 which was assumed to be 100.

(Water permeability: (permeation time for a sample)/(permeation time for comparative example 1 (as prepared))×100)

The amount of fouling 1, 2 represents the proportion of weight increase of the felt contaminated with respective artificially contaminated liquid The results of the above described test items are shown in Table 2.

ADVANTAGES OF THE INVENTION

As described so far, it was confirmed that according to the present invention, adding blocked urethane prepolymer (A) to the configuration of papermaking felt as the antifouling agent allows a papermaking felt to have high compression recoverability as shown in Table 2 and exhibit an excellent antifouling capability due to its hydrophilic function on the felt fiber surface.

It was further confirmed that containing a mixture consisting of two components in combination of blocked urethane prepolymer (A) and N-methylol acrylamide (B) as the antifouling agent enhances the sustainability of the antifouling capability of component (A).

It was further confirmed that containing a mixture comprising two components of blocked urethane prepolymer (A) and hydrophilic polyester resin (C) as the antifouling agent improves the hydrophilic function at the felt fiber surface thereby allowing the exhibition of excellent antifouling capability.

It was further confirmed that blocked urethane prepolymer (A) has the effect of imparting a hydrophilic capability to the surface of nylon fibers thereby preventing the deposition of contaminants such as pitch base contaminants as well as the effect of improving the compression recoverability of the papermaking felt thereby discharging fillers contaminants such as talk and aluminum sulfite accumulated inside the felt.

It was further confirmed that adding hydrophilic polyester resin (C) has the effect of improving the hydrophilic property of the surface of nylon fibers thereby preventing the deposition of contaminants, particularly contaminants deposited on the surface of nylon fibers such as pitch-base contaminant.

It was observed that N-methylol acrylamide (B) reacted with nylon fibers to work as a base (wedge) thereby improving the sustainability of the above described properties.

Increases in the amount of deposition of blocked hydrophilic urethane prepolymer (A), N-methylol acrylamide (B) or hydrophilic polyester resin (C) provide their respective characteristic features; however, an excessive deposition will cause a blockage between fibers thereby degrading the water permeability. Thus it is possible to achieve better antifouling capability by combining two or more components of blocked urethane prepolymer (A), N-methylol acrylamide (B) and hydrophilic polyester resin (C) and changing the composition of the mixture depending on the composition of the contaminants within the range not to impair the felt properties.

TABLE 1

| | A | B | C |
|---|---|---|---|
| Example 1 | 1% | 0% | 0% |
| Example 2 | 5% | 0% | 0% |
| Example 3 | 10% | 0% | 0% |
| Example 4 | 1% | 0.5% | 0% |
| Example 5 | 1% | 0% | 1% |
| Example 6 | 5% | 0.5% | 3% |
| Example 7 | 1% | 10% | 0% |
| Example 8 | 5% | 0% | 0% |
| Example 9 | 5% | 0% | 0% |
| Comparative example 1 | 0% | 0% | 0% |
| Comparative example 2 | 0% | 0% | 3% |

TABLE 2

| | Properties as prepared | | | Properties after test | | | | |
|---|---|---|---|---|---|---|---|---|
| | Compressibility | Recoverability factor | Water permeability | Compressibility | Recoverability factor | Water permeability | Amount of fouling 1 | Amount of fouling 2 |
| Example 1 | 48 | 53 | 103 | 35 | 32 | 140 | 0.72 | 1.78 |
| Example 2 | 56 | 61 | 109 | 40 | 36 | 131 | 0.42 | 1.13 |
| Example 3 | 56 | 62 | 115 | 40 | 36 | 127 | 0.41 | 0.86 |
| Example 4 | 50 | 53 | 104 | 38 | 35 | 138 | 0.5 | 1.5 |
| Example 5 | 48 | 51 | 105 | 36 | 33 | 139 | 0.65 | 1.71 |
| Example 6 | 55 | 61 | 111 | 43 | 40 | 124 | 0.3 | 0.84 |
| Example 7 | 43 | 45 | 110 | 33 | 29 | 137 | 0.98 | 2.04 |
| Example 8 | 42 | 45 | 106 | 30 | 27 | 130 | 1.32 | 1.03 |
| Example 9 | 58 | 64 | 115 | 32 | 29 | 142 | 1.38 | 1.96 |
| Comparative example 1 | 44 | 47 | 100 | 32 | 28 | 148 | 1.46 | 2.47 |
| Comparative example 2 | 45 | 48 | 105 | 32 | 28 | 145 | 1.41 | 2.45 |

BRIEF DESCRIPTION OF THE DRAWINGS

FIG. 1 is a schematic diagram to show the apparatus for repeatedly pressing the felt by rotating the felt F while applying a tension thereon with a pair of press rolls P.

Description of Symbols

F Papermaking felt

P Press roll

S Shower

W Water shower

Figure 1:
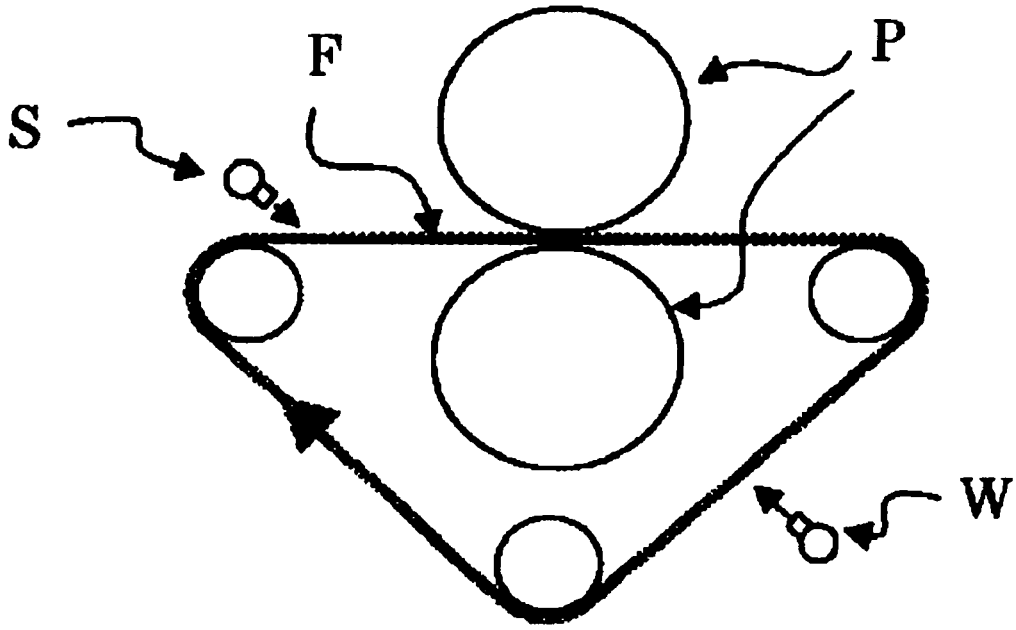
FIG. 1

The invention claimed is:

1. A papermaking felt comprising:

a hydrophilic urethane resin; and an anchoring agent comprising N-methylol acrylamide.

2. The papermaking felt according to claim 1, characterized in that the hydrophilic urethane resin is provided through polymerization of a blocked hydrophilic urethane prepolymer.

3. The papermaking felt according to claim 2, characterized in that the blocked hydrophilic urethane prepolymer contains ethylene oxide.

4. The papermaking felt according to claim 3, characterized in that the ethylene oxide constitutes 35% to 95% by molecular weight of the blocked hydrophilic urethane prepolymer.

5. The papermaking felt according to claim 1, characterized in that the hydrophilic urethane resin constitutes 0.5% to 10% by weight of said papermaking felt.

6. The papermaking felt according to claim 1, characterized in that the hydrophilic urethane resin constitutes 0.5% to 10% by weight and the N-methylol acrylamide constitutes 0.1 to 5% by weight of the papermaking felt.

7. The papermaking felt according to claim 1, characterized by further comprising a hydrophilic polyester resin.

8. The papermaking felt according to claim 7, characterized in that the hydrophilic urethane resin constitutes 0.5% to 10% by weight, the N-methylol acrylamide constitutes 0.1% to 5% by weight, and the hydrophilic polyester resin constitutes 0.5% to 5% by weight of the papermaking felt.

* * * * *

UNITED STATES PATENT AND TRADEMARK OFFICE

CERTIFICATE OF CORRECTION

PATENT NO. : 7,311,806 B2
APPLICATION NO. : 10/800936
DATED : December 25, 2007
INVENTOR(S) : Takashi Ouchi et al.

It is certified that error appears in the above-identified patent and that said Letters Patent is hereby corrected as shown below:

Col. 2, lines 66 and 67 should read:

ticularly hydrophobic ones), and to sustain such antifouling capability for a long period of time without impairing the Col. 8, line 44 should read:

component (30% of ethylene oxide (EO) based on the total

Signed and Sealed this

Eighth Day of July, 2008

JON W. DUDAS
*Director of the United States Patent and Trademark Office*

UNITED STATES PATENT AND TRADEMARK OFFICE

CERTIFICATE OF CORRECTION

PATENT NO. : 7,311,806 B2
APPLICATION NO. : 10/800936
DATED : December 25, 2007
INVENTOR(S) : Takashi Ouchi et al.

It is certified that error appears in the above-identified patent and that said Letters Patent is hereby corrected as shown below:

On the title page insert the following:

(30) Foreign application Priority Data

Apr. 10, 2003 (JP) ……..2003-106312

Signed and Sealed this

Twenty-second Day of July, 2008

JON W. DUDAS
*Director of the United States Patent and Trademark Office*